US007001108B2

(12) United States Patent
Purvis et al.

(10) Patent No.: US 7,001,108 B2
(45) Date of Patent: Feb. 21, 2006

(54) MAT SUPPORTED OFFSHORE STRUCTURE

(76) Inventors: John C. Purvis, 13576 Bellhaven Dr., Houston, TX (US) 77069; Tak On Cheung, 3303 Long Hollow Ct., Sugarland, TX (US) 77479

( * ) Notice: Subject to any disclaimer, the term of this patent is extended or adjusted under 35 U.S.C. 154(b) by 35 days.

(21) Appl. No.: 10/602,567

(22) Filed: Jun. 24, 2003

(65) Prior Publication Data

US 2004/0265069 A1 Dec. 30, 2004

(51) Int. Cl.
*E02B 17/04* (2006.01)
*B63B 35/44* (2006.01)

(52) U.S. Cl. ..... 405/207; 405/205; 405/203; 405/196; 114/265

(58) Field of Classification Search ..... 405/196, 405/197, 203, 207, 208, 195.1, 200, 205, 405/223.1, 224; 114/264, 265
See application file for complete search history.

(56) References Cited

U.S. PATENT DOCUMENTS 3,433,024 A * 3/1969 Diamond et al. ..... 405/196
3,673,974 A * 7/1972 Harper ..... 114/265
4,080,796 A * 3/1978 Edling et al. ..... 405/207
5,190,410 A * 3/1993 Nunley ..... 405/196

* cited by examiner

*Primary Examiner*—Sunil Singh

(57) ABSTRACT

A bottom-supported jack-up rig has a hollow ring mat with a central opening for accommodating a lower portion of a hull nested therein when the rig is in transit. The ring mat has a predetermined surface footprint sufficient to provide stability to the rig when embedded in the sea bottom. The mat buoyancy helps support the hull and the legs in a floating position when the rig is in transit, while allowing lowering of the mat to the sea bottom without assistance of a ballasting/de-ballasting means.

12 Claims, 3 Drawing Sheets

MAT SUPPORTED OFFSHORE STRUCTURE

BACKGROUND OF THE INVENTION

The present invention relates to a mat supported jack-up platform that can be used for drilling and production operations offshore.

Offshore drilling operations are often conducted using bottom-supported platforms or rigs. One of the most common types of bottom-supported rigs are jack-up rigs that have legs that can be jacked up and down in relation to the platform hull by rack-and-pinion systems. Conventional rigs are towed to a location of prospective drilling operations, while the legs are elevated above the platform, or hull. Once the rig reaches the pre-determined location, the legs are lowered to the bottom and the platform is "jacked up" above the expected wave action to a desired operational draft. The legs are embedded into the sea bottom to support the elevated platform. Some of the rigs have spud cans secured to the bottom of the legs for resting on the sea floor.

Another type of jack-up rigs uses a mat that is secured to the bottom of the legs. Such rigs are often employed for muddy, soft bottom conditions. A conventional mat-supported jack-up rig has a base mat, which is a rectangular hollow tank sized to provide stability for the rig when resting on the seafloor.

The interior of a typical mat is divided into ballast compartments, which can be flooded to make the mat neutrally buoyant, while the platform is being towed to the drilling site. When a mat supported jack-up is conducting drilling operations, the mat is negatively buoyant and is positioned in contact with the sea floor. The mat distributes the weight of the rig evenly over the bottom and tends to keep it from sinking too far into a soft bottom.

The need for ballasting and de-ballasting of the mat structure requires that the rig be equipped with pumps and associated equipment, which increases the cost of the rig and associated drilling operations.

The present invention contemplates elimination of drawbacks associated with the prior art and provision of an improved mat-supported offshore platform, wherein the need for the pumping equipment is eliminated.

SUMMARY OF THE INVENTION

It is therefore an object of the present invention to provide a mat-supported jack-up rig with a ring mat that is carried by the lower portions of the jack-up legs.

It is another object of the present invention to provide a mat for supporting a jack-up rig that does not need to be ballasted or de-ballasted.

In the preferred embodiments of the present invention, the jack-up rig has a buoyant hull and a plurality of supporting legs that extend above the hull deck when the rig is in transit. A hollow mat is secured to the bottom of the legs; the mat has a central opening that accommodates the bottom portion of the hull. The mat with a large central opening has sufficient buoyancy to facilitate floating of the hull while the rig is towed and lowering of the mat to the seabed without assistance of conventional ballasting means.

DETAILED DESCRIPTION OF THE PREFERRED EMBODIMENT

Figure 1:
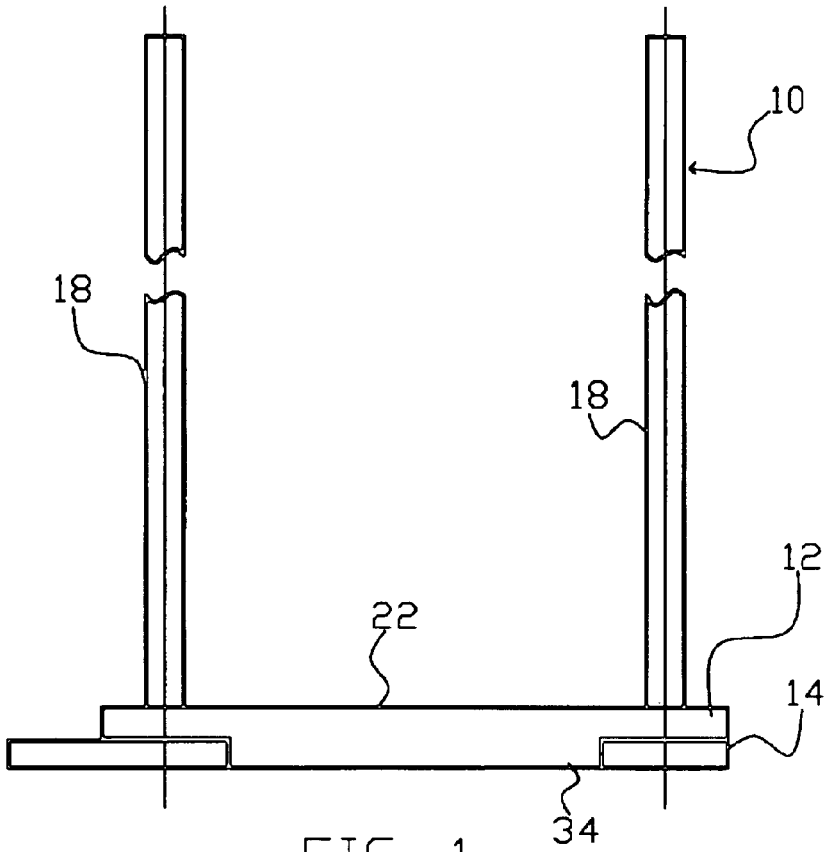
FIG. 1 is side schematic view of the mat supported offshore rig of the present invention, wherein the rig is provided with three legs.
Figure 2:
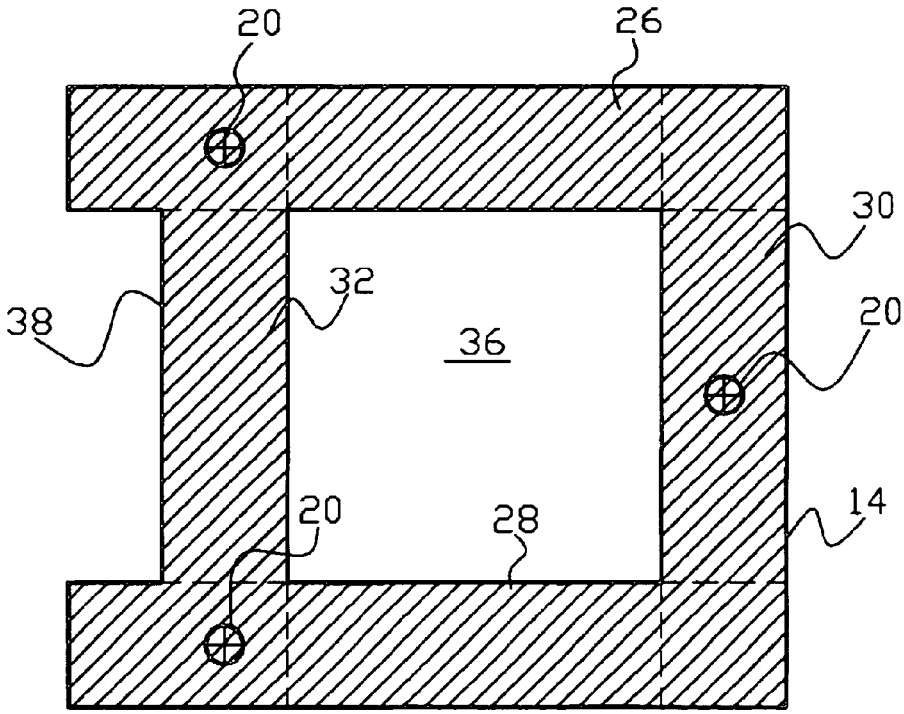
FIG. 2 is a plan view of the mat of the present invention for a rig with three supporting legs.
Figure 3:
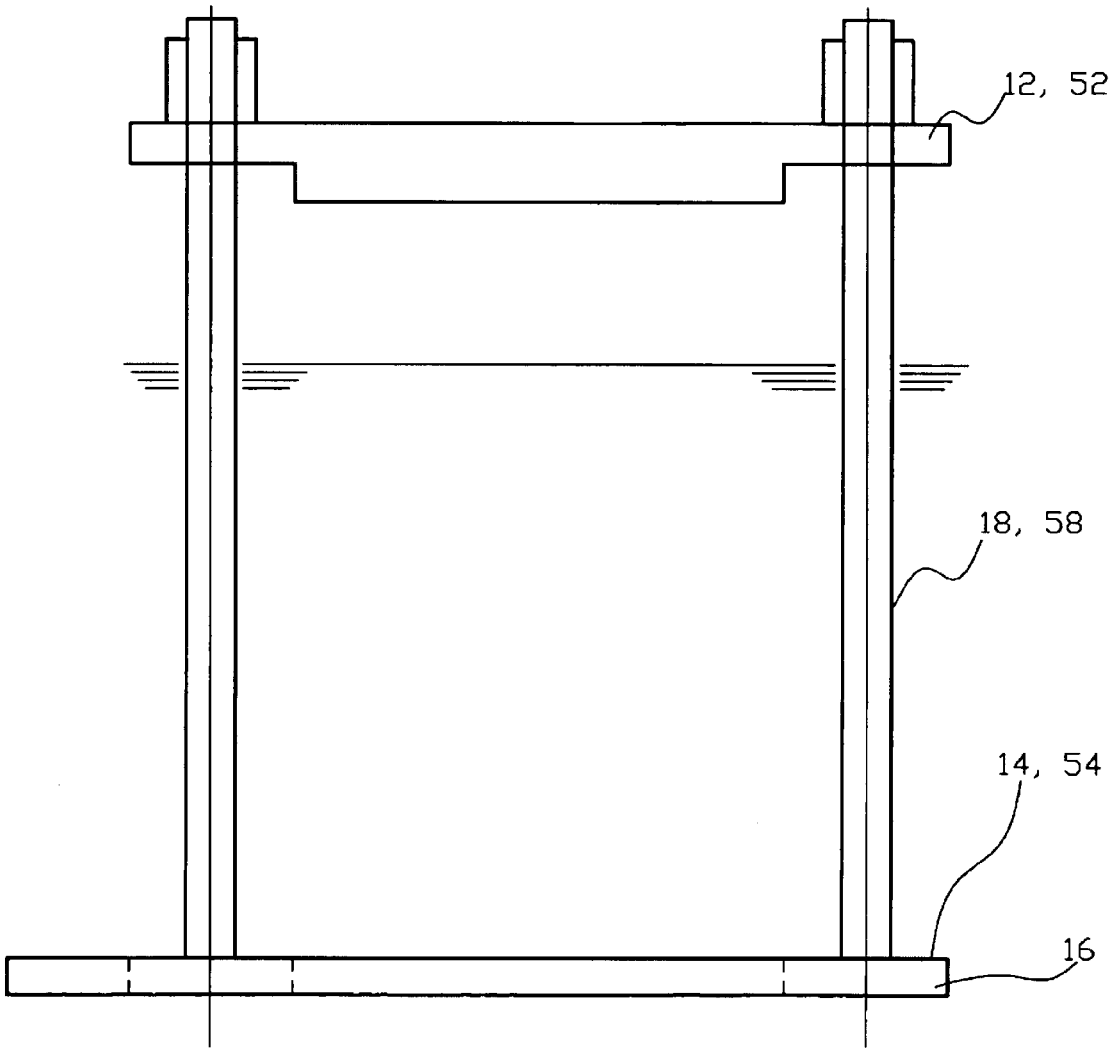
FIG. 3 is a schematic side view of the mat supported rig of the present invention, with the mat embedded in the seabed.

FIGS. 1 through 5 illustrate the preferred overall configuration of the offshore structure of the present invention. The rig 10 comprises a floatable platform, or hull 12, from which the drilling operations will be performed. A ballastible and deballastible mat 14 is adapted to be embedded into the seabed 16. A plurality of legs 18 extends from the mat 14 to the hull 12.

The legs 18 are fixedly secured, at their lower portions to the mat 14. A plurality of leg wells (not shown) is formed in the hull 12 to allow the legs 18 to pass therethrough. The mat 14 is provided with leg wells 20 to receive the lower parts of the legs 18. A means (not shown) are typically provided on the platform 12 for moving-the legs 18 with respect to the hull 12. The hull 12 is a floatable hull with sufficient buoyancy to allow the rig 10 to be floated from one location to another. The drilling operations are conducted from the deck 22. The deck 22 is designed to support a variety of equipment such as a derrick, cranes, storage facilities, and crew living quarters.

The mat 14 is hollow in construction, generally rectangular in shape and has four peripheral corners. The mat is comprised of a first elongated member 26, a second elongated member 28, a cross member 30 and a connecting member 32. The elongated members 26, 28 are secured in a parallel relationship to each other and transversely to the cross member 30 and the connecting member 32. If desired, the elongated members 26 and 28 may extend farther than the distal end 38 of the connecting member 32. Such may be the situation, where the drilling equipment is positioned at the aft of the platform 12.

The mat-forming members, i.e. the elongated members 26, 28, the cross member 30 and the connecting member 32 define a central opening 36, which occupies a substantial surface area of the mat footprint, or peripheral dimensions. The central opening 36 reduces the buoyancy of the mat 14 and eliminates the need for ballasting and de-ballasting of the mat 14.

The central opening 36 is sized and shaped to accommodate the bottom portion 34 of the platform 12, such that the bottom portion 34 nests inside the opening 36. The hull 12 is configured such that the buoyancy lost from the open area 36 of the mat 14 is taken up by the hull 12. As a result, when the rig 10 is located in shallow waters it has sufficient buoyancy to float, carrying the mat 14 and the supporting legs 18.

Once the rig 10 is towed to the desired location, the legs 18 are lowered to the seabed 16, pushing the mat 14 into the soft bottom. The mat 14 does not exert an upward force on the platform 12, as is common with conventional mat supported rigs that require ballasted mats. It is envisioned that the mat 14 will have sufficient weight and less than neutral buoyancy to lower itself to the seabed 16. When assisted by the legs 18, forcing the mat 14 downwardly, the mat 14 will move to the bottom and rest on the seabed 16, supporting the platform 12. Once the legs are secured, the platform 12 is raised to its operational draft (FIG. 3) by the conventional jack-up apparatus.

Figure 4:
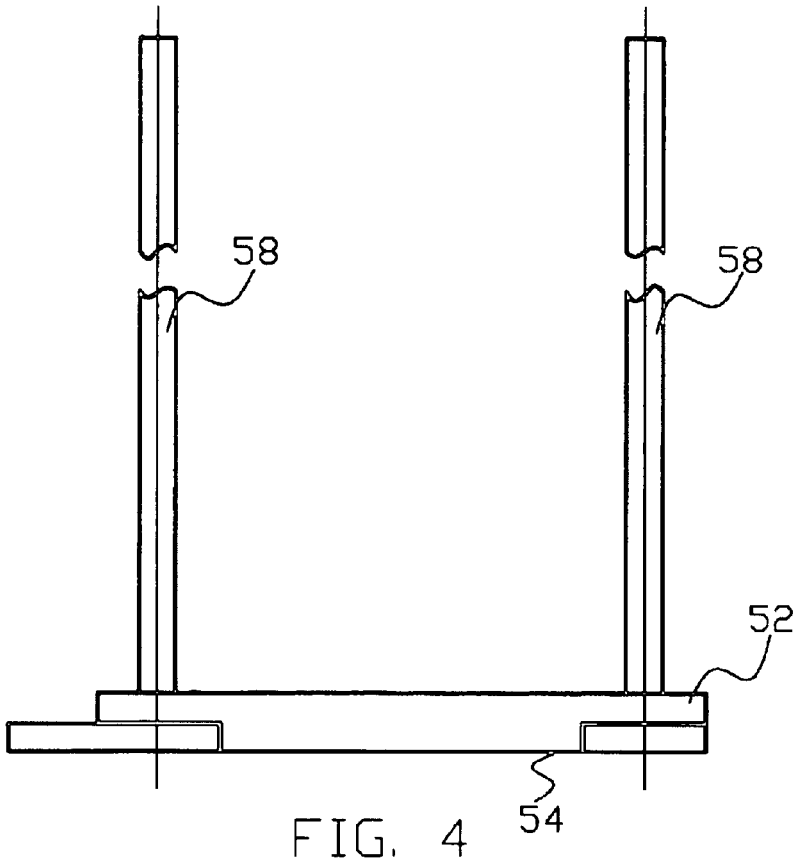
FIG. 4 is side schematic view of the mat supported offshore rig of the present invention, wherein the rig is provided with four legs.
Figure 5:
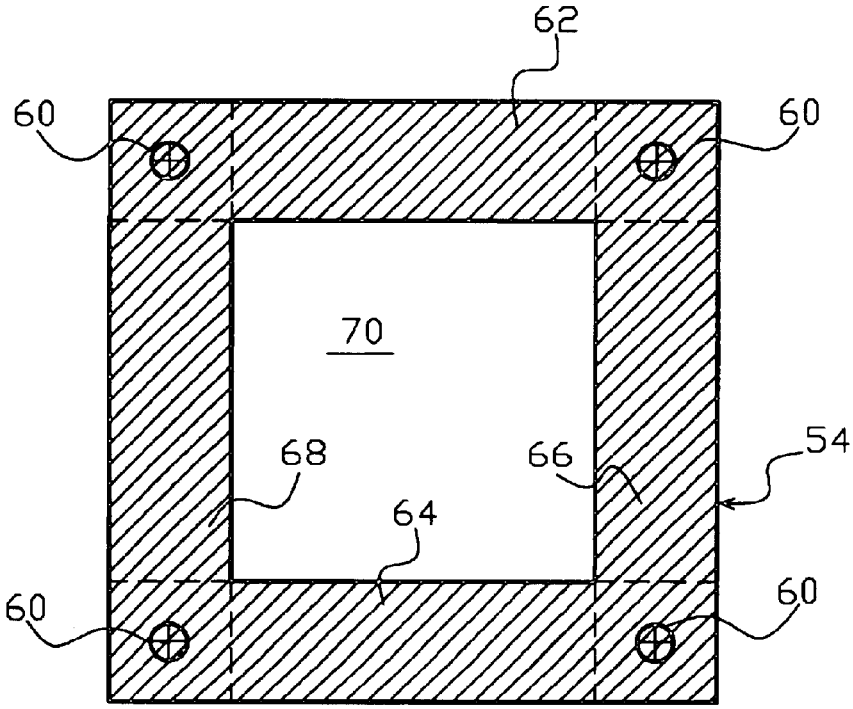
FIG. 5 is a plan view of the mat of the present invention for a rig with four supporting legs.

FIGS. 4 and 5 illustrate a rig 50 that is supported by four legs. Similarly to the embodiment of FIGS. 1 and 2, the rig 50 comprises a platform, or hull 52, a mat 54 and a plurality of supporting legs 58. The legs 58 extend through leg wells (not shown) formed in the hull 52 and into the leg wells 60 formed in the mat 54. The mat 54 may have a rectangular or a square configuration and formed by four hollow mat-forming members 62, 64, 66, and 68 rigidly connected to each other to form an open "ring" mat. The mat members 62, 64, 66 and 68 define a large central opening 70 that occupies a substantial surface area in the overall footprint of the mat.

Similarly to the opening 36, the opening 70 helps reduce the buoyancy of the mat 14, such that the mat 14 will not exert a considerable upward force when it is lowered in the water to the sea bed 16. The opening 70 is slightly greater than the bottom 54 of the hull 52. When in towed condition, the bottom 54 nests within the opening 70, with the hull 52 providing sufficient buoyancy to the rig 50. When the legs 52 are lowered to the bottom forcing the mat 54 through the water, the mat 54 offers little resistance, facilitating expeditious embedding of the mat 54 into the seabed 16.

The mats 14 and 54 provide sufficient buoyancy when the rigs 10 and 50 are moved through shallow waters. At the same time, the mats 14, 54 provide stability to the rigs 10 and 50 when resting on the seabed 16, while the central open areas 36 and 70 eliminate the need for ballasting of the mats 14, 54. Thus the need for pumps and associated equipment is eliminated. The valuable space on the platform deck may be used for other tasks.

Many changes and modifications may be made in the design of the present invention without departing from the spirit thereof. I, therefore, pray that my right to the present invention be limited only by the scope of the appended claims.

We claim:

1. A bottom-supported offshore structure, comprising:

a buoyant hull having a bottom portion;

a plurality of legs engaged with the hull for supporting the hull when the hull is in an operational condition; and a mat secured to lower portions of the legs, said mat having sufficient buoyancy to facilitate floating of the hull when the structure is in transit, while facilitating lowering of the mat to a seabed without assistance of a ballasting means, said mat having a central opening, the bottom portion of the hull nesting within the central opening when the structure is in a non-operational position.

2. The structure of claim 1, wherein said mat comprises a plurality of hollow mat-forming members, said hollow members defining the central opening in the mat.

3. The structure of claim 2, wherein said mat has a pre-determined surface footprint, and wherein said central opening occupies a substantial portion of said surface footprint.

4. The structure of claim 1, wherein said bottom portion of the hull is sized and shaped to extend into the central opening formed in the mat such that a bottom surface of the hull bottom portion extends in a substantially co-planar relationship to a bottom surface of the mat.

5. The structure of claim 1, wherein said mat has a surface footprint sufficient to ensure stability of the structure when the mat is embedded into the seabed.

6. A method of positioning an offshore structure in a selected location for conducting exploratory operations, comprising the steps of:

providing a buoyant hull, a plurality of legs engaged with the hull for supporting the hull when the hull is in an operational condition, and a mat secured to lower portions of the legs, said mat having a central opening for receiving a bottom portion of the hull when the offshore structure is in transit such that a bottom surface of the hull bottom portion extends in a substantially co-planar relationship to a bottom surface of the mat;

lowering the legs and the mat toward a bottom of a body of water without assistance of a ballasting means with the legs and the mat being configured to facilitate lowering of the mat to the bottom of the body of water; and causing said mat to engage the bottom of the body of water, thereby supporting the structure in the selected location.

7. The method of claim 6, wherein said mat has a pre-determined footprint and wherein said central opening occupies a substantial portion of said footprint.

8. The method of claim 6, wherein said mat has a surface footprint sufficient to ensure stability of the structure when the mat is embedded into the seabed.

9. The method of claim 6, wherein said mat comprises a plurality of hollow mat-forming members, said hollow members defining the central opening in the mat.

10. The method of claim 6, wherein said mat provides sufficient buoyancy to facilitate floating of the offshore structure in shallow waters.

11. A bottom-supported offshore structure, comprising:

a buoyant hull having a bottom portion;

a plurality of legs engaged with the hull for supporting the hull when the hull is in an operational condition; and a mat secured to lower portions of the legs, said mat having a central opening and sufficient buoyancy to facilitate floating of the hull when the structure is in transit, while facilitating lowering of the mat to a seabed without assistance of a ballasting means, said bottom portion of the hull being configured to entirely nest within the central opening when the structure is in transit.

12. The structure of claim 11, wherein said mat has a surface footprint sufficient to ensure stability of the structure when the mat is embedded into the seabed.

* * * * *